US006976536B2

(12) United States Patent
Simpson et al.

(10) Patent No.: US 6,976,536 B2
(45) Date of Patent: Dec. 20, 2005

(54) TUBING EXPANSION

(75) Inventors: Neil Andrew Abercrombie Simpson, Aberdeen (GB); David Michael Haugen, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/805,914

(22) Filed: Mar. 22, 2004

(65) Prior Publication Data

US 2004/0177974 A1 Sep. 16, 2004

Related U.S. Application Data

(63) Continuation of application No. 10/114,923, filed on Apr. 3, 2002, now Pat. No. 6,712,151.

(30) Foreign Application Priority Data

Apr. 6, 2001 (GB) ..... 0108638

(51) Int. Cl.[7] ..... E21B 29/10; E21B 23/04; E21B 19/00

(52) U.S. Cl. ..... 166/277; 166/55.1; 166/207; 166/212; 166/384

(58) Field of Search ..... 166/277, 373, 166/374, 381, 382, 383, 384, 387, 55, 55.1, 166/101, 206, 207, 212, 216, 217, 70, 90.1, 166/185, 242.2

(56) References Cited

U.S. PATENT DOCUMENTS

| | | | | |
|---|---|---|---|---|
| 1,561,415 A | | 11/1925 | Duda | |
| 1,569,729 A | | 1/1926 | Duda | |
| 1,597,212 A | | 8/1926 | Spengler | |
| 2,383,214 A | | 8/1945 | Prout | |
| 2,627,891 A | | 2/1953 | Clark | |
| 3,087,546 A | * | 4/1963 | Brown | 166/277 |
| 3,691,624 A | * | 9/1972 | Kinley | 29/523 |
| 3,785,193 A | * | 1/1974 | Kinley et al. | 72/393 |
| 3,818,734 A | | 6/1974 | Bateman | |
| 4,483,399 A | | 11/1984 | Colgate | |
| 5,083,608 A | * | 1/1992 | Abdrakhmanov et al. | 166/55 |
| 5,575,250 A | | 11/1996 | Van Dyne, II | |
| 6,012,522 A | | 1/2000 | Donnelly et al. | |
| 6,070,671 A | * | 6/2000 | Cumming et al. | 166/381 |
| 6,142,230 A | | 11/2000 | Smalley et al. | |
| 6,390,201 B1 | | 5/2002 | Coon et al. | |
| 6,419,025 B1 | | 7/2002 | Lohbeck et al. | |
| 6,457,532 B1 | | 10/2002 | Simpson | |
| 6,478,091 B1 | * | 11/2002 | Gano | 166/373 |
| 6,543,552 B1 | | 4/2003 | Metcalfe et al. | |
| 6,557,640 B1 | * | 5/2003 | Cook et al. | 166/380 |

(Continued)

FOREIGN PATENT DOCUMENTS

DE 2 140 358 6/1973

(Continued)

OTHER PUBLICATIONS

PCT International Search Report issued on Jan. 30, 2002, for application serial No. PCT/GB01/04958.

*Primary Examiner*—Jennifer H Gay
(74) *Attorney, Agent, or Firm*—Patterson & Sheridan, L.L.P.

(57) ABSTRACT

A method of expanding tubing comprises locating an expansion tool in a section of tubing to be expanded, applying a fluid pressure to the tubing to create a fluid pressure expansion force and induce a hoop stress in the tubing, and applying a mechanical expansion force to the tubing via the expansion tool. The combined fluid pressure expansion force and mechanical expansion force is selected to be sufficient to induce expansion of the tubing.

29 Claims, 3 Drawing Sheets

U.S. PATENT DOCUMENTS

| | | | | |
|---|---|---|---|---|
| 6,568,472 | B1 | 5/2003 | Gano et al. | |
| 6,695,012 | B1 * | 2/2004 | Ring et al. | 138/98 |
| 6,695,065 | B2 * | 2/2004 | Simpson et al. | 166/384 |
| 6,712,151 | B2 * | 3/2004 | Simpson et al. | 166/384 |
| 6,763,893 | B2 * | 7/2004 | Braddick | 166/382 |
| RE38,578 | E * | 9/2004 | Vercaemer et al. | 166/277 |
| 2001/0045289 | A1 * | 11/2001 | Cook et al. | 166/380 |
| 2002/0139540 | A1 | 10/2002 | Lauritzen | |
| 2003/0037931 | A1 * | 2/2003 | Coon | 166/387 |
| 2003/0051885 | A1 * | 3/2003 | Simpson et al. | 166/384 |
| 2003/0066655 | A1 * | 4/2003 | Cook et al. | 166/380 |
| 2003/0075340 | A1 * | 4/2003 | Tran et al. | 166/384 |
| 2003/0121655 | A1 * | 7/2003 | Lauritzen et al. | 166/207 |
| 2003/0141074 | A1 * | 7/2003 | Freeman | 166/380 |
| 2003/0178204 | A1 * | 9/2003 | Echols et al. | 166/386 |
| 2004/0055786 | A1 * | 3/2004 | Maguire et al. | 175/50 |
| 2004/0065446 | A1 * | 4/2004 | Tran et al. | 166/384 |
| 2004/0094312 | A1 * | 5/2004 | Lohbeck et al. | 166/384 |
| 2004/0140086 | A1 * | 7/2004 | Tran et al. | 166/55 |
| 2004/0154808 | A1 * | 8/2004 | Simpson et al. | 166/382 |
| 2004/0163823 | A1 * | 8/2004 | Trinder et al. | 166/382 |
| 2004/0173355 | A1 * | 9/2004 | Simpson et al. | 166/313 |
| 2004/0251035 | A1 * | 12/2004 | Simpson et al. | 166/384 |

FOREIGN PATENT DOCUMENTS

| | | |
|---|---|---|
| GB | 2 344 606 | 6/2000 |
| GB | 2 347 950 | 9/2000 |
| GB | 2 348 223 | 9/2000 |
| WO | WO 00/37766 | 6/2000 |

* cited by examiner

TUBING EXPANSION

CROSS-REFERENCE TO RELATED APPLICATIONS

This application is a continuation of co-pending U.S. patent application Ser. No. 10/114,923, filed Apr. 3, 2002, issued as U.S. Pat. No. 6,712,151 on Mar. 30, 2004, which claims benefit of Great Britain application 0108638.8, filed Apr. 6, 2001. Each of the related aforementioned patent applications are hereby incorporated by reference in their entireties.

BACKGROUND OF THE INVENTION

1. Field of the Invention

This invention relates to tubing expansion, and in particular to expansion of tubing downhole.

2. Description of the Related Art

The oil and gas exploration and production industry is making increasing use of expandable tubing, primarily for use as casing and liner, and also in straddles, and as a support for expandable stand screens. Various forms of expansion tools have been utilised, including expansion dies, cones and mandrels which are pushed or pulled through tubing by mechanical or hydraulic forces. However, these tools require application of significant force to achieve expansion and must be packed with grease to serve as a lubricant between the faces of the cone and the tubing. A number of the difficulties associated with expansion cones and mandrels may be avoided by use of rotary expansion tools, which feature rolling elements for rolling contact with the tubing to be expanded while the tool is rotated and advanced through the tubing; a range of such tools is disclosed in U.S. Pat. No. 6,457,532, the disclosure of which is incorporated herein by reference. Although the expansion mechanism utilised in rotary expansion tools tends to require only relatively low actuation forces, the various parts of the tools may experience high loading, for example the rollers may experience very high point loads where the roller surfaces contact the tubing under expansion. Clearly, such high loadings increase the rate of wear experienced by the tools and the requirement to build the tools with the ability to withstand such loads tends to increase the cost and complexity of the tools.

GB 2348223 A, GB 2347950 A and GB 2344606 A (Shell Internationale Research Maatschappij B.V.) disclose various arrangements in which a tubular member is extruded off a mandrel to expand the member. The axial force necessary to extrude and thus expand the member is achieved by creating an elevated fluid pressure chamber in the tubular member below the mandrel, which pressure creates an axial force on the closed end of the tubular member below the mandrel sufficient to pull the member over the mandrel. The elevated fluid pressure acts only the expanded portion of the tubular member below the mandrel.

U.S. Pat. No. 5,083,608 (Abdrakkhmanov et al) discloses an arrangement for patching off troublesome zones in a well. The arrangement includes profile pipes which are run into a borehole and then subject to elevated internal pressure to straighten the pipes and bring them into engagement with the surrounding wall of the borehole. A reamer is then rotated within the straightened pipes, with an axial load being applied to the reamer. The reamer is utilised to expand the threaded joints of the pipe and to further straighten the pipe, and also to provide clearance between a seal on the reamer and the inner wall of the pipe which was utilised to permit the original fluid pressure induced straightening of the pipe.

It is among the objectives of the present invention to provide an expansion method and apparatus which obviates or mitigates one or more disadvantages of the prior art expansion arrangements.

SUMMARY OF THE INVENTION

According to the present invention there is provided a method of plastically expanding a tubing, the method comprising:

Applying a fluid pressure expansion force to a section of tubing; and

Locating an expansion tool in the pressurised tubing and applying a mechanical expansion force to the pressurised tubing section, the combined fluid pressure force and mechanical expansion force being selected to be sufficient to induce yield of the tubing.

The invention also relates to apparatus for providing such expansion.

The use of a combination of fluid pressure and mechanical forces allows expansion to be achieved using a lower fluid pressure than would be necessary to achieve expansion when relying solely on fluid pressure to induce expansion, and furthermore provides far greater control of the expansion process; it is generally difficult to predict the form of the expanded tubing that will result from a solely fluid pressure-induced expansion, and failure of tubing in such circumstances is common. Also, the combination of fluid pressure and mechanically-induced expansion allows expansion to be achieved while the loads experienced by the mechanical expansion tool remain relatively low, greatly extending he life of the tools. By way of example, a tubing may be subject to an internal fluid pressure selected to induce a hoop tensile stress which represents 60% of yield. By then applying an additional mechanically-applied expansion force sufficient to induce yield, the tubing may be expanded. Of course the relative proportions of the stress contributed by the fluid pressure and by the expander tool may be varied to suit particular applications, and issues to be taken into account may include: the nature of the tubing to be expanded, as lower quality tubing may respond in an unpredictable manner to elevated hydraulic pressures, such that a greater proportion of the stress may be mechanically applied, and thus greater control exercised over the expansion process; and the capabilities of the apparatus available, for example pump or fluid conduit capabilities may place limits on the applied fluid pressures.

Various prior art proposals have utilised expansion dies or cones which are urged through tubing under the influence of an axial fluid pressure force acting on the die or cone, or in which tubing is extruded from a mandrel under the influence of axial fluid pressure force acting on the expanded tubing below the mandrel. However, in these instances the fluid pressure force is applied behind or below the die or cone, and the section of the tubing under expansion is not exposed to the elevated die-driving or tubing-extruding fluid pressure. Indeed, in order to provide the force necessary to drive the die or mandrel forward relative to the tubing in such existing arrangements, and to prevent leakage of the driving fluid past the die, it is necessary that there is an effective pressure-tight seal between the die and the expanded tubing. This seal may be provided by the contact between the die and the tubing wall, or by a separate seal assembly provided on the die.

It is a further advantage of the present invention that the fluid being utilized to pressurise the tubing may also serve as a lubricant between the expansion tool and the tubing, facilitating relative movement therebetween and thus reducing the degree of force necessary to move the expansion tool through the tubing. This is of particular significance where the expansion tool is a die or cone, and the pressurizing fluid provides an effectively infinite supply of lubricant, as opposed to the finite supply of grease or other lubricant provided in conventional expansion arrangements, (see, for example, GB 2344606 A, in which a body of lubricant 275 is provided in the unexpanded portion of the tubing above the expansion mandrel); once the lubricant has been exhausted, the cone must be retrieved to the surface and repacked. Of course the presence of a lubricant will also reduce the rate of wear to the bearing portions of the expansion tool.

Although intended primarily for use in expanding bore lining metal tubing, the invention has application in other downhole applications, and may also be used in subsea or surface applications.

The expansion tool may take any appropriate form, including an expansion die or cone, and may be in the form of a cone or other member carrying a plurality of rollers rotatable about axes substantially perpendicular to the tubing axis. However, it is preferred that the expansion tool is a rotary expansion tool, or rolling element expander, that is the tool features at least one expansion member which, in use, is in rolling contact with the tubing wall; the expansion member may follow a circumferential or helical contact path with the tubing wall. Most preferably, the expansion members are conical in form or are mounted on axes arranged to define a cone. In another embodiment of the invention, a rotating expansion tool may be utilised which features a non-rotating expansion member or members, preferably of a relatively hard material such as a ceramic material, which provides a sliding contact with the tubing wall. The members may be radially extendable or may be radially fixed. In one embodiment, blocks of silicon carbide or titanium carbide may form the expansion members.

Preferably, the expansion tool is fluid pressure actuated, and may include a hydraulic drive motor to rotate the tool; the motor may utilise the fluid providing the expansion force as a drive fluid, the fluid exhausting into a lower pressure section of the bore isolated from the expansion section. In other embodiments, an electric motor may be utilised.

The expansion tool is preferably provided in combination with a seal assembly, for providing a fluid-tight seal with the unexpanded tubing ahead of the expansion tool. As the fluid pressure in the unexpanded tubing ahead of the seal assembly will tend to be lower than the elevated pressure behind the seal assembly, this differential pressure will tend to produce an axial pressure force acting on the seal assembly, which may be utilised to drive the expansion tool forwards.

BRIEF DESCRIPTION OF THE DRAWINGS

These and other aspects of the present invention will now be described, by way of example, with reference to the accompanying drawings, in which.

DETAILED DESCRIPTION OF THE PREFERRED EMBODIMENT

Figure 1:
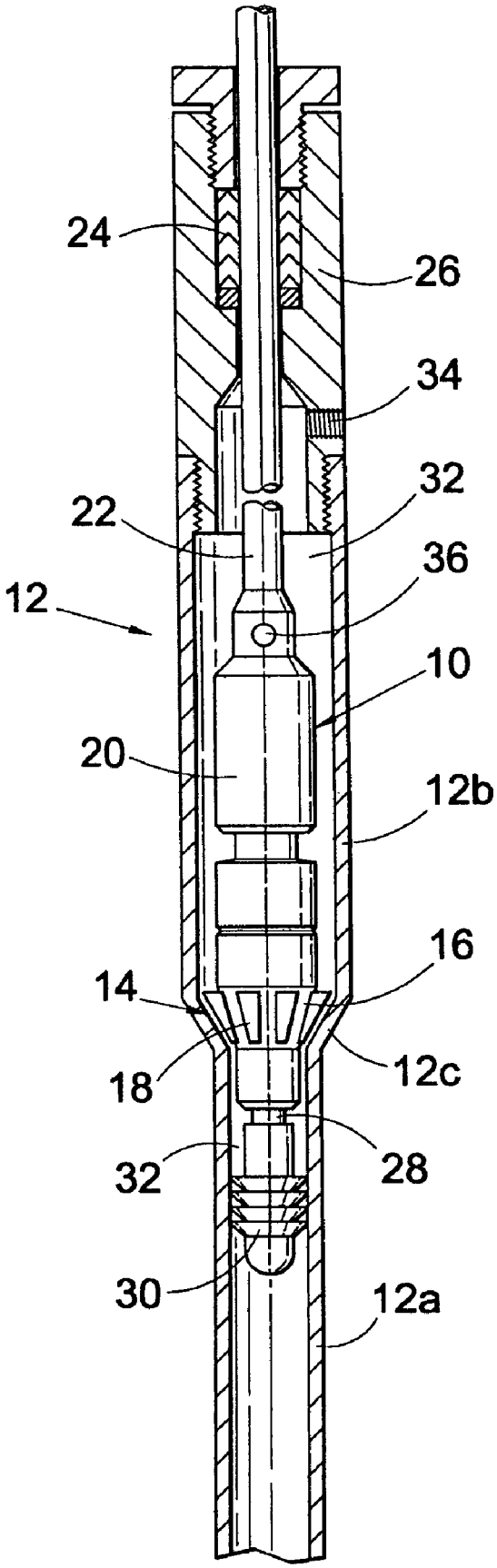
FIG. 1 is a schematic sectional view of tubing expansion apparatus in accordance with a preferred embodiment of the present invention.

Reference is first made to FIG. 1 of the drawings, which illustrates expansion apparatus 10 in accordance with a preferred embodiment of the present invention, shown located in the upper end of a section of tubing in the form of bore liner of expandable metal, hereinafter referred to as liner 12. In use, the apparatus 10 and liner 12 are run into a drilled bore together, and the liner 12 positioned in a section of unlined bore, and possibly overlapping the lower end of existing bore-lining casing. The apparatus 10 is then operated to expand the liner 12 to a larger diameter, the liner of the original, unexpanded diameter being identified as liner 12*a*, and the expanded larger diameter liner being identified by the reference numeral 12*b*.

The apparatus 10 includes a rolling element expander 14 having a generally conical body 16 carrying a number of rolling elements 18. The expander 14 is coupled to a hydraulic drive motor 20 mounted on a running tube 22 which extends upwardly, through a stuffing box 24, to surface. The stuffing box 24 is provided in an upper seal assembly 26 mounted to the top of the liner 12. Mounted below the expander 14, via a swivel 28, is a lower seal assembly 30 which is adapted to provide a sliding seal with the unexpanded liner 12*a*.

In use, the volume 32 defined by the liner 12 between the seal assemblies 26, 30 is supplied with high pressure hydraulic fluid from an appropriate source, such as a surface or downhole pump. In FIG. 1 a hydraulic fluid inlet 34 is illustrated as passing radially through a part of the upper seal assembly 26, however in practice the inlet 34 would be arranged axially, to allow accommodation of the apparatus 10 in a bore, and to allow supply of hydraulic fluid via a running tube in the form of a coaxial coil tubing or drill pipe. The pressure of the hydraulic fluid is selected to induce a predetermined hoop tensile stress within the liner 12. The hydraulic fluid exhausts through the drive motor 20, which includes a hydraulic fluid driven turbine, the exhausted fluid passing up to the surface via the running tube 22.

The exhausted fluid is throttled, or the flow and pressure of the fluid otherwise controlled, to control the pressure within the volume 32, and also the operation of the motor. The throttling may take place downhole or at surface.

The passage of fluid through the motor 20 causes the motor to rotate the expander 14, and thus if the motor 20 is advanced through the liner 12, the expander 14 will act on the transition portion 12*c* between the section of unexpanded and expanded liner 12*a*, 12*b*. The forces acting on the transition portion 12*c* comprise a combination of the stress induced by the elevated hydraulic fluid pressure within the volume 32, and the mechanical pressure forces applied by the surfaces of the rolling elements 18. The combination of forces is selected so as to be sufficient to induce yield and thus plastic deformation of the liner 12.

As noted above, the lower seal assembly 30 isolates the pressurised volume 32 from the remainder of the unexpanded liner 12*a*, which is at a lower pressure than the volume 32. Accordingly, the differential pressure acting on the assembly 30 produces an axial force tending to push the apparatus 10 through the liner 12. There is thus no requirement to apply weight from surface to the apparatus 10.

EXAMPLE

A liner 12 to be expanded is 7⅝" 29.7 lb\ft N80 tubing which has a burst pressure of approximately 7,000 psi. The hydraulic fluid supplied to the volume 32 is at 5,000 psi. The liner wall is therefore subjected to a tensile stress of 51,000 psi, which represents 63% of the yield for the liner (not taking into account the effect of radial stress in the region of 25,000 psi).

The drive fluid to the hydraulic motor 20 enters through an inlet port 36 and exhausts into the running tube 22, thereby adding the motor pressure drop to the applied internal pressure. The hydraulic return to surface is throttled to maintain the applied liner pressure, taking into account the motor pressure drop and the parasitic losses in the running tube 22.

The net axial force applied to the expansion assembly is the pressure differential across the lower seal assembly 30 times its cross-sectional area minus the pressure differential across the stuffing box 24 times the cross-sectional area of the running tube 22. If the running tube 22 has an outside diameter of 5" and the internal diameter of the 7⅝" liner is 6.88" , then the down force applied to the assembly is 83,000 lbf, which is in excess of the force required to drive the expander 14 through the liner 12, such that a braking assembly must be provided on surface for the running tube 22. Alternatively, a larger diameter running tube 22 could be utilised.

Figure 2:
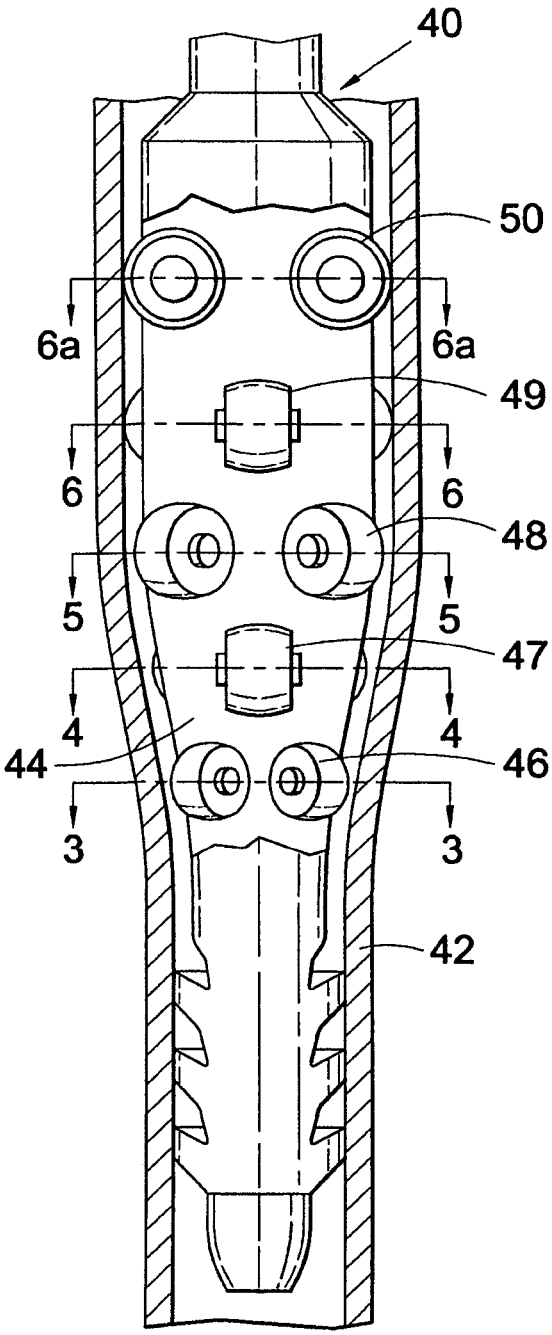
FIG. 2 is a diagrammatic part-sectional view of an expansion tool of expansion apparatus in accordance with another embodiment of the present invention.

Reference is now made to FIGS. 2 to 6 of the drawings, which illustrate an alternative expander 40 in accordance with a further embodiment of the present invention, shown located in a section of liner 42 during expansion. From a comparison of the figures, those of skill in the art will recognise that FIG. 2 shows various internal features of the expander 40.

Figure 6:
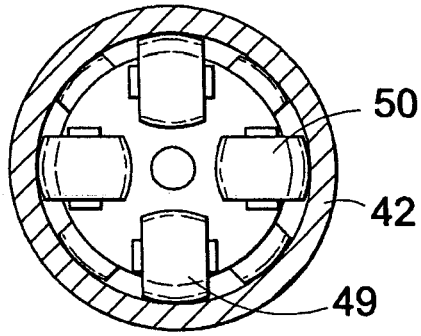
FIGS. 3, 4, 5 and 6 are sectional views on lines 3—3, 4—4, 5—5 and 6—6 of FIG. 2.
Figure 5:
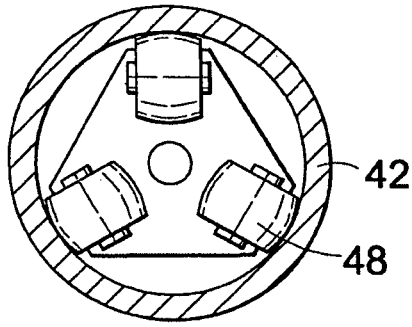
Figure 4:
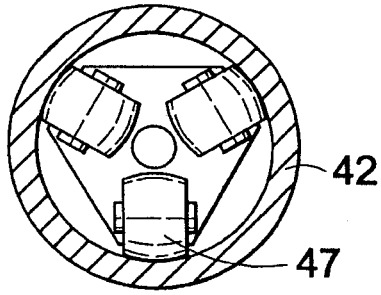
Figure 3:
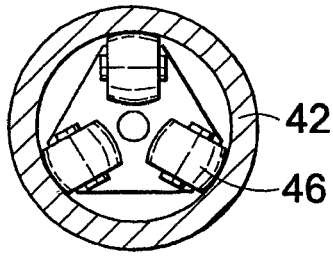

The expander 40 features a generally conical body 44 on which are mounted five rows of rollers 46, 47, 48, 49 and 50 (the section shown in FIG. 6 corresponds to both sections 6—6 and 6*a*—6*a* of FIG. 2). Unlike the rolling elements 18 of the first described embodiment, the rollers 46 to 50 rotate around axes that lie substantially perpendicular to the liner axis, and the expander 40 is therefore intended to advance axially through the liner 42, without rotation.

Such an expander configuration would not be practical in the absence of assisting hydraulic expansion forces, as the bearing loads experienced on expanding heavy walled tubing would far exceed the capabilities of the bearings that could be installed in the limited space available. However, with applied internal hydraulic pressure providing the bulk of the expansion forces, the roller bearings are relatively lightly loaded.

Figure 7:
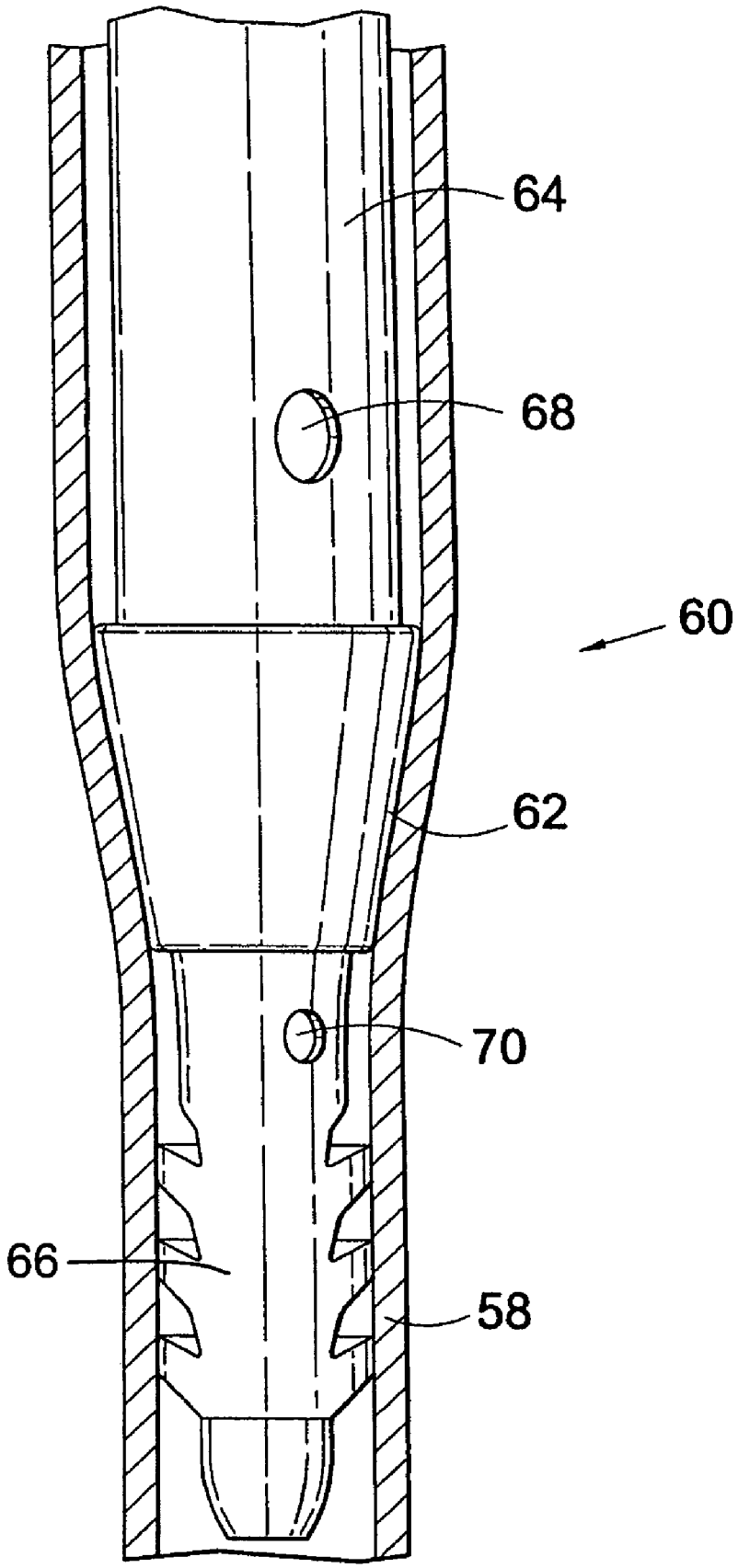
FIG. 7 is a diagrammatic part-sectional view of an expansion apparatus in accordance with a further embodiment of the present invention.

Reference is now made to FIG. 7 of the drawings, which illustrates an expansion apparatus 60 in accordance with a further embodiment of the present invention located within a partially expanded borehole liner 58.

The apparatus 60 includes an expander cone 62 mounted to a tubular running string 64, and mounted below the cone 62 is a seal assembly 66 adapted to provide a sliding seal with the unexpanded liner 58.

As with the above described embodiments, an elevated fluid pressure above the seal assembly 66 provides an initial expansion force acting on the liner 58, while the passage of the cone 62 provides a further mechanical expansion force which, in combination with the hydraulic expansion force, is sufficient to induce yield in the liner 58. The axial pressure force acting on the seal assembly 66 may also serve to drive the cone 60 through the tubing 58, and the presence of the pressurising force around the cone 62 provides an effectively infinite supply of lubricant for the cone 62; fluid communication across the cone 62 may be assured by provided linked ports 68, 70 above and below the cone 62.

It will be apparent to those of skill in the art that the above-described embodiments provide an alternative method for expanding tubing downhole, and that the invention offers a number of advantages over existing systems.

Furthermore, those of skilled in the art will recognise that the above-described embodiments are merely exemplary of the present invention, and that various modifications and improvements may be made thereto, without departing form the scope of the invention. For example, in the embodiment of FIG. 1, rather than providing a hydraulic fluid driven motor 20 within the pressurised volume 32, a motor may be provided externally of the volume 32, and may be located downhole or at surface. In this case, the upper seal assembly 26 would of course have to be modified to accommodate rotation.

What is claimed is:

1. A method of expanding a tubular, comprising:

applying fluid pressure to an inside surface of the tubular by directing fluid against the inside surface of the tubular;

urging an expander against the inside surface of the tubular, the urging at least partially supplied by an axial load on a running tube that the expander is mounted on; and expanding the tubular with the combination of the fluid pressure and the expander.

2. The method of claim 1, wherein urging the expander is conducted at least partially simultaneously with applying the fluid pressure.

3. The method of claim 1, wherein the tubular is a downhole tubular.

4. The method of claim 1, wherein the fluid pressure causes the tubular wall to approach its yield strength.

5. An apparatus for expanding a tubular, comprising:

an expander having an outer diameter portion larger than an inner diameter of the tubular to be expanded;

a seal to create a fluid seal within an unexpanded portion of the tubular, the seal axially spaced from the expander to provide a substantially sealed fluid volume in an interior section of the unexpanded portion between the expander and the seal; and a port disposed along the apparatus between the expander and the seal, the port adapted to supply pressurized fluid to the substantially sealed fluid volume.

6. The apparatus of claim 5, wherein the seal includes a plurality of sealing members.

7. The apparatus of claim 5, wherein the expander has a first portion having a first diameter equal to or less than an unexpanded inner diameter of the tubular, a second portion having a second diameter greater than the first diameter and a junction between the first and second portions, the seal axially spaced from the junction.

8. The apparatus of claim 5, wherein the expander is a die.

9. The apparatus of claim 5, wherein the port is in fluid communication with an upper port disposed along the apparatus on an opposite end of the expander.

10. The apparatus of claim 5, wherein the expander has at least one rotatable expansion member and is adapted to be rotated in the tubular.

11. The apparatus of claim 5, further comprising a hydraulic drive motor to rotate the expander.

12. The apparatus of claim 5, wherein the expander has a body carrying a plurality of expansion members rotatable about axes substantially perpendicular to an axis of the tubular.

13. The apparatus of claim 5, wherein the expander is a rolling element expander having a plurality of rotatable expansion members arranged to define a cone.

14. The apparatus of claim 5 wherein the expander is fluid pressure actuated.

15. The combination of claim 5, wherein the tubular is a downhole tubular.

16. A method of expanding tubing, comprising:

providing an expansion tool mounted on a running tube, the expansion tool having a substantially fluid-tight seal axially spaced from an expander to provide a volume in an interior section of an unexpanded portion of the tubing between the seal and the expander;

applying fluid pressure to at least the volume to create a fluid pressure expansion force and induce a hoop stress in the unexpanded portion of the tubing, wherein fluid for applying the fluid pressure is supplied through the running tube to a port disposed between the expander and the seal; and applying a mechanical expansion force to the tubing to be expanded via the expander, the combined fluid pressure expansion force and mechanical expansion force selected to be sufficient to induce expansion of the tubing.

17. The method of claim 16, wherein applying the mechanical expansion force is supplied by a pressure differential that urges the expander against the inside of the tubing.

18. The method of claim 16, wherein applying the mechanical expansion force is at least partially supplied by an axial load on the running tube.

19. The apparatus of claim 16, wherein the seal includes a plurality of sealing members.

20. The method of claim 16, further comprising locating the tubing downhole.

21. The method of claim 16, further comprising utilizing fluid utilized to create the fluid pressure expansion force as a lubricant between the expander and the tubing.

22. A system for expanding a tubular, comprising:

an expander having an outer diameter portion larger than an inner diameter of the tubular to be expanded, wherein the tubular has a solid wall and a substantially continuous circumference;

a seal to create a fluid seal within an unexpanded portion of the tubular ahead of the expander;

a lubricant supplied to the inner diameter of the tubular and in fluid communication with at least a section of the outer diameter portion of the expander and a lubricant supply capable of continuously supplying the lubricant.

23. The system of claim 22, wherein the lubricant is pressurized.

24. The system of claim 22, wherein the lubricant is supplied to an interior of the tubular isolated by the seal and having the expander disposed therein.

25. The system of claim 22, wherein the lubricant is pressurized within an interior of the tubular isolated by the seal and having the expander disposed therein.

26. A method of expanding a tubular, comprising:

urging an expander against an inside surface of the tubular;

sealing an unexpanded portion of the tubular ahead of the expander;

supplying a lubricant to the inside surface of the tubular by directing the lubricant against the inside surface of the tubular, wherein substantially all of the lubricant is forced between the expander and the inside surface of the tubular along a length of the expander in contact with the tubular and wherein supplying the lubricant includes pressurizing the lubricant; and expanding the tubular with the expander.

27. The method of claim 26, wherein supplying the lubricant is continuous.

28. The method of claim 26, wherein supplying the lubricant directs the lubricant to an interior of the tubular isolated by the seal and having the expander disposed therein.

29. The method of claim 26, wherein supplying the lubricant pressurizes the lubricant within an interior of the tubular isolated by the seal and having the expander disposed therein.

* * * * *